United States Patent [19]

Bauer et al.

[11] 3,949,693

[45] Apr. 13, 1976

[54] PARTIALLY SUBMERGED FLOATING PLATFORM

[75] Inventors: Peter Bauer, Bremen; Rudolf Klimek, Ganderkesse, both of Germany

[73] Assignee: ERNO Raumfahrttechnik GmbH, Bremen, Germany

[22] Filed: Oct. 25, 1974

[21] Appl. No.: 517,884

[30] Foreign Application Priority Data

May 2, 1974 Germany ..... 2421150

[52] U.S. Cl. ..... 114/.5 D; 114/124; 61/46.5

[51] Int. Cl.[2] ..... B63B 35/44

[58] Field of Search ..... 61/46, 46.5; 114/.5 D, 114/124

[56] References Cited

UNITED STATES PATENTS

| | | | |
|---|---|---|---|
| 1,016,808 | 2/1912 | Williamson | 61/46 |
| 1,188,842 | 6/1918 | Schrumpf | 114/124 |
| 2,939,291 | 6/1960 | Schurman et al. | 114/.5 D |
| 3,160,135 | 12/1964 | De Uries | 114/.5 D |
| 3,207,110 | 9/1965 | Laborde et al. | 114/.5 D |
| 3,224,401 | 12/1965 | Kobus | 61/46.5 |
| 3,349,740 | 10/1967 | Field | 114/.5 D |
| 3,391,666 | 7/1968 | Schuller, Jr. | 114/.5 D |
| 3,490,406 | 1/1970 | O'Reilly et al. | 61/46.5 |
| 3,830,068 | 8/1974 | Peter | 61/46 |
| 3,859,806 | 1/1975 | Guy et al. | 61/46.5 |

*Primary Examiner*—Jacob Shapiro
*Attorney, Agent, or Firm*—Ralf H. Siegemund

[57] ABSTRACT

A floating platform has a polygonal, submerged floating body constructed from concentric pipe sections whereby the space between each two concentric pipes is compartmentized and serves as storage facility as well as ballast tanks. Columns also constructed as upright concentric pipes extend from the submerged float and carry platform defining and establishing frame which carries e.g. a drilling derrick. The interior spaces of all inner pipes serve as transport path, a closed one being provided in the main float and elevator(s) as well as pump-up paths for liquid loads are provided in the columns.

5 Claims, 5 Drawing Figures

12
12
2
23
19
V
V
20
IV
IV
23
21
4
3
26
18
17
22

29
2
16
5
8
9

32
16
5
2
7
6
31
28
27
30

PARTIALLY SUBMERGED FLOATING PLATFORM

BACKGROUND OF THE INVENTION

The present invention relates to a floating platform having a body for displacing water when submerged at a depth which is not or little disturbed by surface waves. More particularly the invention relates to such a platform wherein float columns extend from a submerged body float and are interconnected by a rigid, horizontally extending frame.

Floating platforms with two, parallelly oriented submerged floats are known and these floats carry columns functioning as additional water displacing floats carrying the platform above the sea level. Sometimes the platforms can be vertically displaced on these columns. These platforms with submerged floating body are easily maneuverable and can readily be transported to their destination point, but the two parallelly disposed displacement elements or bodies react to a significant extent to underwater currents and are difficult to maintain in position. This is particularly so if these platforms are used for offshore drilling. The basic reason for this lack in positional stability must be seen in that the submerged bodies exhibit different characteristics as to stability in longitudinal and transverse directions.

Other types of floating platforms are known wherein the submerged floating body is of annular configuration, and the central, open space has an auxiliary platform for resisting vertical movements of the body. This submerged control platform may have openings with means for closing, so that controlled water flow can traverse the platform in either direction. The principle platform above sea level is strutted or otherwise secured to the submerged floating body.

This latter construction has the advantage of isotropic stability and resists vertical displacement to a very significant degree. This annular construction has, however, the disadvantage that the entire pay load including fuel and other provisions to be consumed have to be stored on the main platform so that the center of gravity of this arrangement is rather high and that in turn is disadvantageous as to floating stability.

DESCRIPTION OF THE INVENTION

It is an object of the present invention to provide for a floating platform with submerged support and floating structure and being stabilized with regard to tilting as well as vertical displacement.

In accordance with the preferred embodiment of the present invention it is suggested to provide a main submerged float of quasi-symmetrical configuration, whereby, in particular, concentric pairs of pipe sections are arranged in a polygon, and the spaces between concentric pipe sections are compartmentized and serve generally for floatation control; however, some of the compartments are used for storage of consumables and the other compartments serve as ballast and/or trimming tanks and are flooded or blown to maintain balanced conditions on the platform. A plurality of floatation columns extend upward from that body and project above sea level to support the platform structure constructed as a rigid frame which interconnects these columns. The columns are likewise constructed from concentric pipes with compartmentization of the space between the pipes of each concentric pair, and some of these compartments are filled with usefull load, while others are used also as ballast and/or trimming tanks for buoyancy and stabilizing control.

All of the compartments are, therefor, used as ballast for control of floatation, depths of submerging, tilting if any etc, whereby however, pay load is used as ballast in some compartments and the other compartments may be filled with or emptied from sea water as the conditions require. The usefull load ballast will generally include fuel and other liquids or powdery solids which can be pumped up. The inner tubes provide additional storage space so that only difficult to store objects (drilling rods etc) will be stored in places other than the interior of main float and float columns.

The inner pipes of the main float are preferably interconnected to provide for a continuous passage way in which loads are transported and wherein dummy loads can be rapidly displaced as ballast for stability control of the entire structure. These ballast loads may run on a track system and may be self-propelled and computer controlled in accordance with any compensating function for purposes of counter acting any tendency for tilting. This way blowing and flooding of tanks for the same purpose can be minimized. The inner pipes of the columns will contain vertical transport means for moving loads up and down. These transport means may include pipes as well as elevators.

The platform in accordance with the invention has the advantage that the principle load (other than surface equipment) is maintained in the principal portions (e.g. 90%) so that the center of gravity is quite low. This is of advantage for avoiding significant vertical displacements. Also, a low center of gravity together with quasi-rotational symmetry of the main float avoids tilting of the platform as much as possible. Since the above-sea level frame interconnecting the columns will carry only that part of the equipment which for some reason or another cannot be stored or placed in either the columns or the submerged main body, the frame will be of relatively light construction, which in turn is again beneficial for a low placement of the center of gravity.

The quasi-rotational symmetry facilitates positioning of the platform because it has no preferred orientation vis a vis any underwater currents. As far as the several compartments is concerned, one will use those on the outside for ballast control, flooding them with sea water or blowing them as needed. The more inwardly arranged compartments will be used as storage space for fuel etc. Some of the outer ones may also serve as storage facility for liquids or solids which, in the case of leakage will not provide for contamination. Storing the contaminants more on the inside permits more ready containment in the case of leakage.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 2:
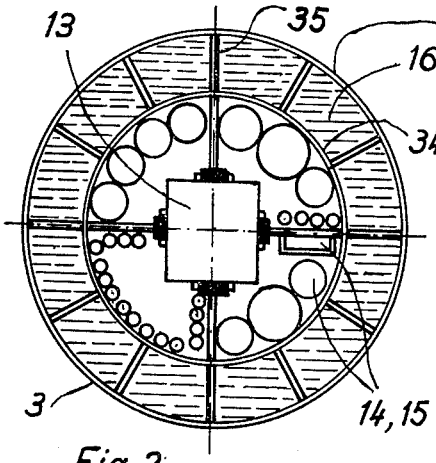
FIG. 2 is a section view through one of the floating carrier columns taken along lines II—II in FIG. 1.
Figure 1:
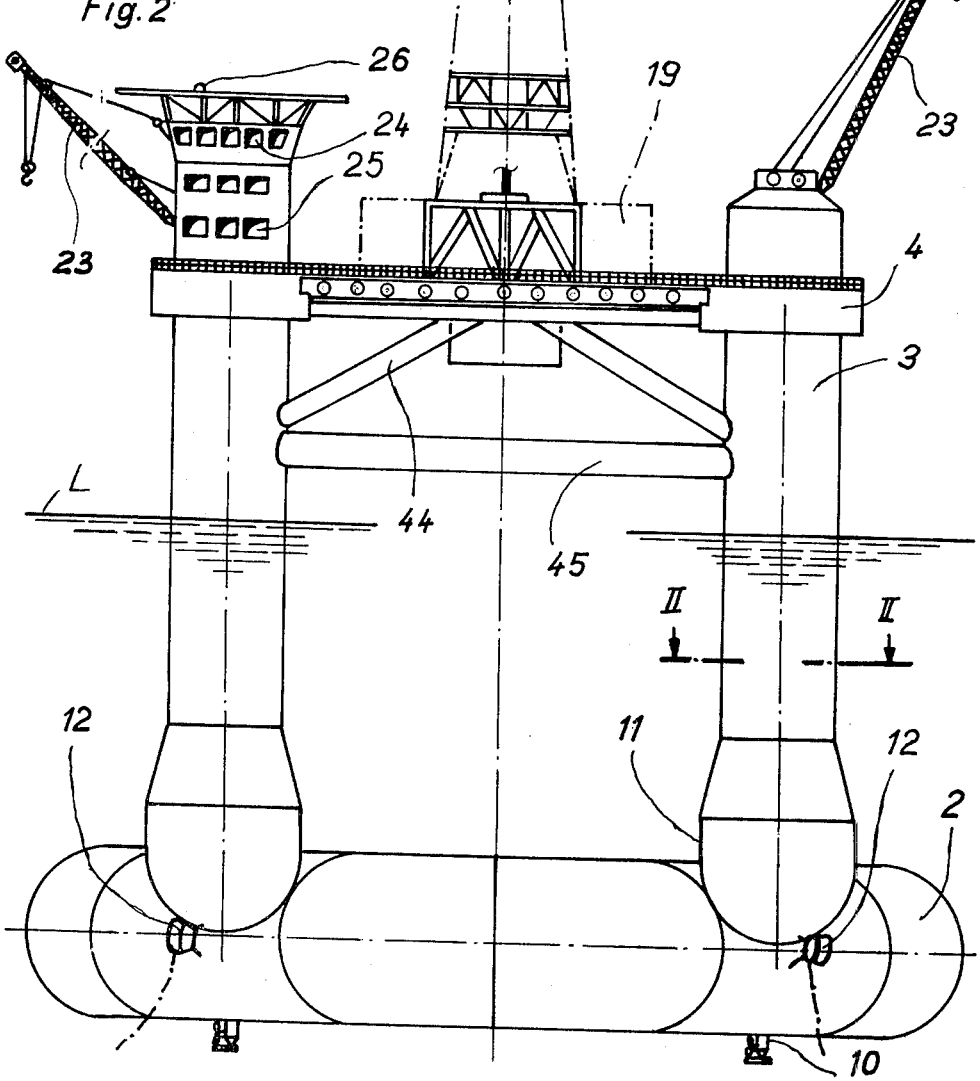
FIG. 1 is a side elevation of a floating platform constructed in accordance with the preferred embodiment of the invention.
Figure 3:
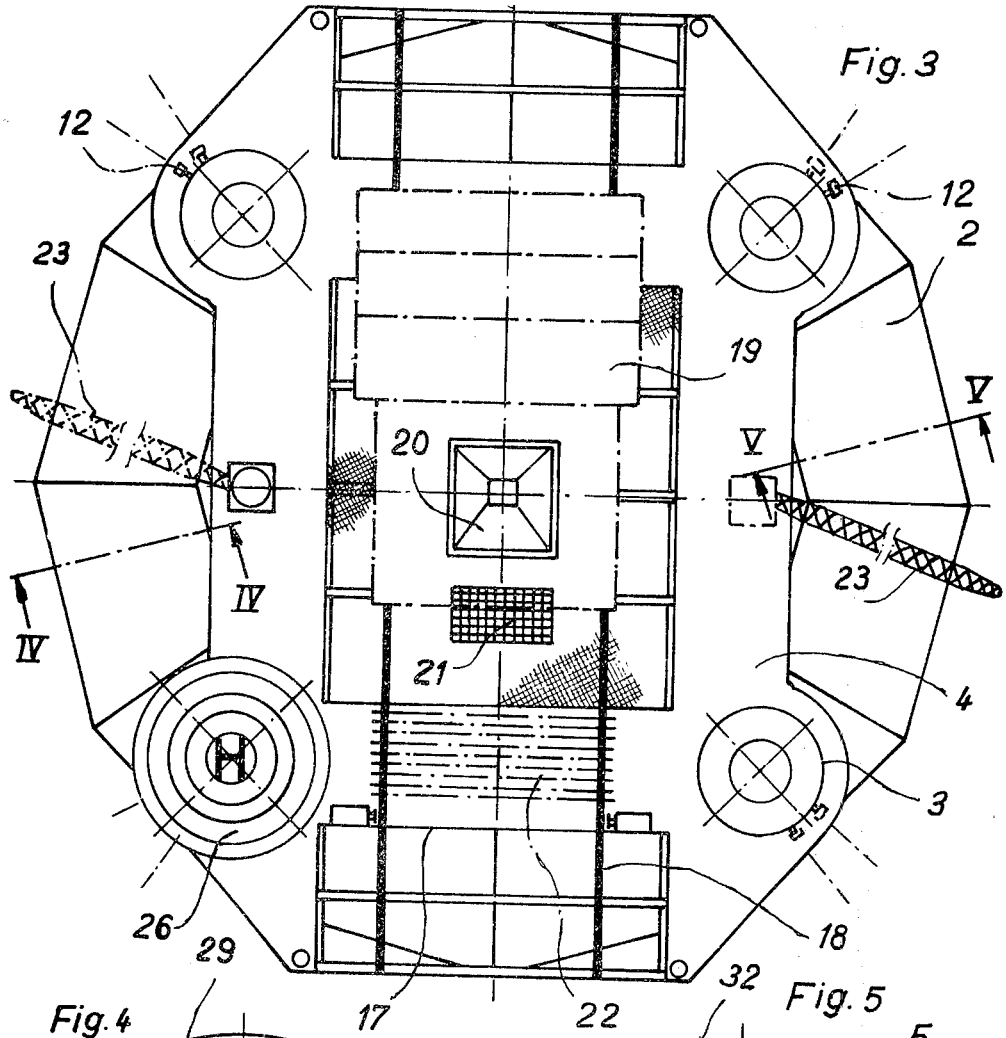
FIG. 3 is a top elevation of the platform shown in FIG. 1.
Figure 4:
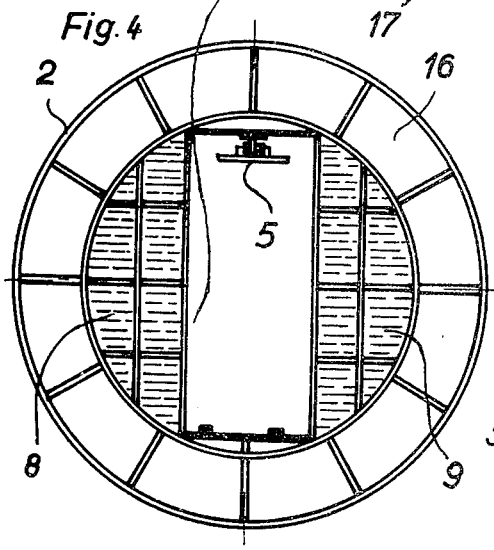
FIG. 4 and FIG. 5 are section views respectively along lines IV—IV and V—V in FIG. 3.
Figure 5:
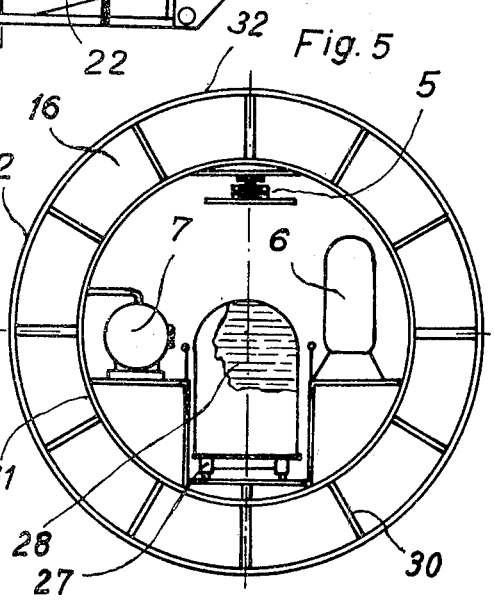

Proceeding now to the detailed description of the drawings, the Figures show a main submerged body 2 constructed in quasi-rotationally symmetrical configuration, as a multicorner — multisection polygon approximating an annulus with circular transverse cross-section as can be seen from FIGS. 4 and 5. This body 2 constitutes the principle or main float and is completely submerged.

Float 2 carries four columns 3, also constructed as water displacing floatating elements but extending partially above the sea level L. A rigid frame 4 above the water surface interconnects the four columns. The columns 3 are additionally interconnected by struts or girders or the like. The number of these columns will depend to some extent on the size of this platform, but for reasons of structural stability there should be at least three.

Reference numeral 11 denotes the zones or regions of interconnection as between float 2 and columns 3. The columns 3 have significantly wider cross-section in this zone. Driving and propelling units 10 can be lowered from this zone or retracted so as to maneuver the platform when not retracted.

The columns are vertically traversed e.g. by elevators 13 for moving personnel and load because the lower and submerged portions of the platform are used extensively as storage facilities and otherwise. Chain anchorings 12 are provided for locally positioning the platform and holding it particularly in shallow waters. These anchors for fastening the chains are secured to float 2 on the outside, but the anchor chains can be stored in the interior thereof.

One of the columns 3 carries the command cabin or control tower 24 with living quarters 25 being provided for in lower stories or decks. The tower 24 may carry a landing platform 26 for helicopters. Various cranes 23 are mounted to the frame 4 and have operating ranges extending at least to the center of the frame as well as to the column 3.

The center of the frame 4 carries the drilling derrick 20 which is equipped as usual. Drilling pipes or rods are stored at 24 right next to tower 20. The frame 4 has a carrier construction 17 for rails 18, and several service modules 19 are moved on these rails for placing them in various operating positions. These modules 19 contain various equipment as needed for drilling, such as equipment for mixing and flushing; equipment for cementing; auxiliary power equipment; equipment for the drilling holes; repair shop and storage of spare parts; additional living quarters for operating personnel if needed.

A storage facility for risen pipes 22 is provided next to the drill pipe store 21. Such storage facility may be needed if not all these pipes can be stored inside of the columns 3.

Each column 3 is constructed as a concentric pipe arrangement having an outer pipe 33 and an inner pipe 34 whereby, the annular space between the concentric pipes is compartmentized by radial walls 35. Additional walls (not shown) compartmentize this space in vertical direction. As stated, an elevator shaft 13 is provided in the center of each column, and pipes 14 for moving powdery, liquidous and/or gaseous media are arranged around that shaft. These pipes are arranged also inside of the inner pipe 34 and move e.g. fuel, exhaust fumes as well as fresh air. Additionally, the inner pipe 34 is used for storage (15), because not everything needed can be stored in the main body 2.

The compartments as between inner and outer pipe can be flooded or emptied as needed for controlling buoyancy and stability of orientation of the platform as a whole. Thus, some of these compartments will serve as ballast and/or trim tanks. However, some of the compartments, namely those more on the inside of the platform construction, such as 16, may be used for storing fuel. This way, all compartments are used as buoyancy and ballast tanks and only some of them are needed for providing supplementary ballast adjustment and control particularly for compensating any change in load conditions on account of consumption of usefull load.

The main submerged floating body 2, particularly the polygonally arranged individual sections thereof, are each comprised of an inner pipe 31 and of an outer pipe 32. Longitudinal walls 30 are provided for compartmentizing the ring space between the two pipes, and transverse walls (not shown) provide for further subdivision of the compartmentization.

The various compartments between inner and outer pipes of body 2 serve also as storage facilities, as well as ballast and/or trim tanks. The compartments more on the outside should be used for storing non-contaminating fluid (e.g. drinking water) or they are flooded with sea water.

The inner pipe 31 constitutes basically a continuous passage way with a transport device 5 arranged on and along the roof of that passage, running all the way around the body 2. This transport structure may be an overhanging rail with carriages running for suspending loads. Rails 29 are provided on the floor of the passage way, particularly for moving carriages 27 which carry ballast weights 28. These ballast weights 28 may be tanks filled with water and are moved on these carriages to the extent needed for trimming the position of the floating platform as a whole. These carriages may be self-propelled vehicles which are computer controlled in accordance with any sensed tilting angles of the floating platform. Any sudden external influence tending to change the stability can readily be compensated by moving these dummy loads into different positions. This can be done quite rapidly if the need arises rather suddenly.

Various power stations 7 and storage containers 6 are provided more or less regularly around the center of the annulus 2, inside of tubes 31 (FIG. 5). Furthermore, the or some of the pipes 31 contain the principal fuel tanks 9 and other ballast tanks 8 (FIG. 4). This way fuel tanks are provided completely in the interior of the body and leakage towards the outside is quite unlikely, while any leakage from the fuel tanks is readily localized on account of the compartmentization of the space between inner and outer pipes 31, 32.

About 90%, of the pay load, such as provisions and fuel are to be stored in body 2. As a consequence, the center of gravity of the structure as a whole is quite low which is very beneficial for the stability of the platform. The regular and symmetrical distribution of loads generally inside of body 2 enhances stability. On the other hand, the dual transport path inside of pipe 31 permits relocating of loads as well as moving of loads to and from the columns for changing the load distribution as for example, fuel is being used up.

The invention is not limited to the embodiments described above but all changes and modifications thereof not constituting departures from the spirit and scope of the invention are intended to be included.

We claim:

1. Partially submerged floating platform having a plurality of vertical columns constructed from concentric pipes with compartmentization of the space between respective inner and outer pipes;

a frame interconnecting the columns above the sea level and providing for and establishing a working area of the platform, the improvement comprising:

a submerged main floating body of near rotational symmetry and having predominantly horizontal extension, the body being constructed from sections of concentric pipes which extend around a vertical axis in near-annular fashion, the space between respective inner and outer pipe sections being compartmentized, the columns being connected and extending upright from the main body but projecting above sea level;

the inner pipe of the body being hollow and constructed as passage way for moving of loads;

individual ballast bodies movably disposed in the inner pipe and moving along the passage way to change the effective ballast in relation to the center axis of the platform;

the inner pipe of at least one column constructed for transporting loads from the submerged body to the frame.

2. A platform as in claim 1, wherein the main body is constructed as polygon and from straight, concentric pipe sections, joint at obtuse angles.

3. A platform as in claim 1, there being a rail system on a floor in the inner pipes of the body, the ballast load bodies being movable on the rail system.

4. A platform as in claim 3, the ballast loads provided for being driven on the rails.

5. A platform as in claim 1, and including retractible propelling and driving means extending from the body when not retracted and near the zones from which the columns extend upwardly.

* * * * *